US006012690A

United States Patent [19]

Cohen

[11] Patent Number: 6,012,690

[45] **Date of Patent: *Jan. 11, 2000**

[54] SUPPORT FOR MOUNTING CONTAINERS WITHOUT REQUIRING TOOLS

[75] Inventor: Michael Cohen, Glencoe, Ill.

[73] Assignee: Vista Products, Inc., Lake Forest, Ill.

[ * ] Notice: This patent is subject to a terminal disclaimer.

[21] Appl. No.: 08/828,912

[22] Filed: Mar. 28, 1997

[51] Int. Cl.[7] ..... A47G 7/00

[52] U.S. Cl. ..... 248/226.11; 47/40; 248/214; 248/231.41

[58] Field of Search ..... 248/214, 226.11, 248/228.5, 228.3, 228.6, 231.41, 231.61, 231.71, 208; 108/47; 47/40, 66, 68

[56] References Cited

U.S. PATENT DOCUMENTS

| | | | |
|---|---|---|---|
| 945,213 | 1/1910 | Blackburn | 248/226.11 X |
| 1,955,476 | 4/1934 | Torgersen | 248/208 |
| 2,538,449 | 1/1951 | Freshwater . | |
| 2,551,157 | 5/1951 | Price . | |
| 2,614,471 | 10/1952 | Markowitz . | |
| 2,867,401 | 1/1959 | Sheahan | 248/231.41 |
| 3,588,019 | 6/1971 | Cozeck et al. . | |
| 4,074,882 | 2/1978 | Anderson . | |
| 4,141,524 | 2/1979 | Corvese, Jr. . | |
| 4,331,312 | 5/1982 | LaVoe . | |
| 4,559,738 | 12/1985 | Helfman . | |
| 4,575,149 | 3/1986 | Forestal et al. . | |
| 4,640,045 | 2/1987 | Nesbitt et al. . | |
| 4,698,936 | 10/1987 | Helfman . | |
| 4,887,338 | 12/1989 | Handler | 248/205.2 X |
| 4,986,505 | 1/1991 | Zabawski et al. | 108/47 X |
| 5,173,181 | 12/1992 | McFarland | 248/231.41 X |
| 5,177,899 | 1/1993 | Powell . | |
| 5,240,214 | 8/1993 | Birnbaum et al. . | |
| 5,246,197 | 9/1993 | MacDonald | 248/231.71 X |
| 5,269,095 | 12/1993 | Helfman et al. . | |
| 5,368,266 | 11/1994 | Allen . | |
| 5,368,267 | 11/1994 | Howard . | |
| 5,599,130 | 2/1997 | Solomon et al. | 248/228.5 X |

*Primary Examiner*—Derek J. Berger
*Attorney, Agent, or Firm*—Martin L. Stern; Laff, Whitesel & Saret, Ltd.

[57] ABSTRACT

A supporting structure for a flower box or the like fits over the top edge of a wall, room divider, or similar device. The supporting structure includes an elongated plate having a plurality of spaced parallel slots therein. A pair of L-shaped members, each having a first flange which may be slipped through and depend below any one of the slots, so that the space between the two first flanges fits over and embraces the top edge of a room divider or the like. The other flange of each L-shaped member lays on top of the elongated plate. In one embodiment, the weight of the flower box holds the other flange in place. The dependent first flanges have a clamping device associated therewith to secure the structure to the wall. In another embodiment, the bottom of a U-shaped member is secured to an elongated plate, with no adjustment of the space between a pair of flanges formed by open arms of the U-shaped members. This other embodiment is designed for mounting on walls having a known and fixed thickness.

13 Claims, 4 Drawing Sheets

SUPPORT FOR MOUNTING CONTAINERS WITHOUT REQUIRING TOOLS

FIELD OF THE INVENTION

This invention relates to structures for supporting containers, such as flower boxes, and more particularly to supports for mounting containers on top edges of walls, other room dividers or the like without requiring any tools or special training.

BACKGROUND OF THE INVENTION

Interior designers, florists, and the like, often wish to place objects on top of structures, such as free standing walls, or room dividers. These room dividers may have any of many different widths. For example, a conventional wall having 2×4 studs with wallboard on opposite sides may be, say, five or six inches thick. A prefabricated room divider which may be supplied by a furniture company may be any thickness, such as two or three inches thick. Other examples of room dividers and similar devices may have many other thicknesses.

As a result of these and other considerations, in the past, an interiorscaper, for example, might use a number of brackets if he wishes to mount a flower box on the top of a partition. However, this approach creates potential problems. Normally, a number of tools may be required to assemble the brackets or support. The assembly of brackets and other supporting structure may be labor intensive, expensive and unsightly.

Accordingly, there is a need for an unobtrusive, supporting structure which almost anyone may assemble, without requiring any special training or tools. Also, the need is to provide a support which may fit across, and be adjustable for, the top of almost any wall, room divider, or the like.

SUMMARY OF THE INVENTION

In keeping with an aspect of the invention, an elongated plate has a number of spaced parallel slots on each end. Each elongated plate has an associated pair of L-shaped bracket members with a first flange which fits through any one of the slots, to depend beneath the elongated plate. The first flanges of the two L-shaped bracket members are inserted through slots which are selected so that the space between the two dependent flanges is approximately equal to or slightly greater than the width of the wall or room divider. This way, the two dependent plates may embrace the wall. The other flange of each of the L-shaped members lies flat on top of the elongated plate where it may be held in place by the weight of a flower box, or the like, sitting on top of the elongated plate. Or, in the alternative, the leverage of the L-shaped plates acting against a fulcrum formed by an edge of a slot holds the L-shaped plate in place. The first and dependent flange, which fits against the wall, is penetrated by a screw which may be turned to grip the wall. The elongated member and L-shaped brackets are preferably made by stamping sheet metal; however, any other suitable material may be used.

BRIEF DESCRIPTION OF THE DRAWINGS

A preferred embodiment of the invention is shown in the attached drawing in which.

DETAILED DESCRIPTION OF EMBODIMENTS OF THE INVENTION

Figure 1:
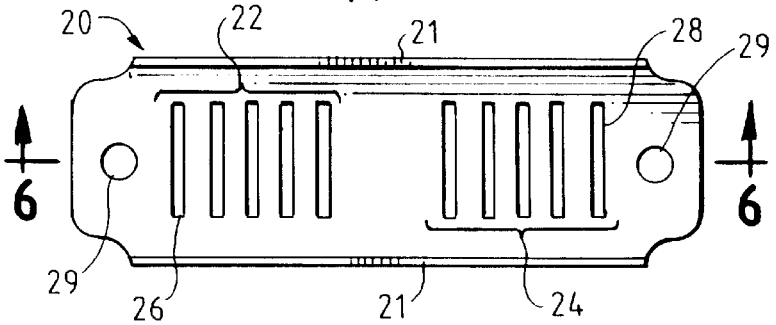
FIG. 1 is a plan view of an elongated member.

FIG. 1 shows an elongated plate 20 having two sets of spaced parallel slots 22, 24 associated with and transverse to each end of the plate. Each longitudinal side of plate 20 terminates in an upturned edge 21. Any one of the slots in each of the two groups 22, 24 may be selected according to the width of a wall, room divider, or other device on which the assembled support member is to rest. For example, if the width of the wall 25 (FIG. 6) is "x," the slots 26, 28 will be selected because they are separated by a distance approximately equal to or slightly greater than "x." A pair of holes 29 are formed in the opposite outboard ends of the elongated plate 20 to provide a way of attaching the elongated plate to the bottom of a flower box, if necessary.

Figure 2:
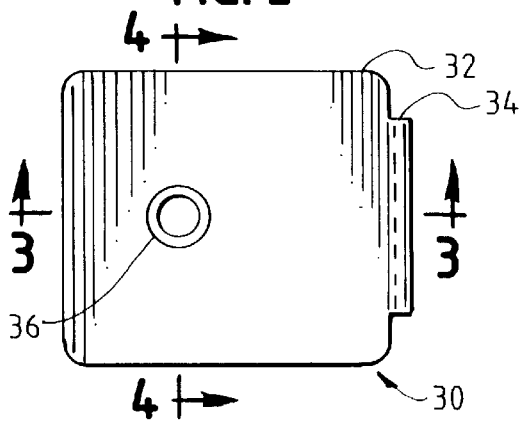
FIG. 2 is an elevation view of an L-shaped flange member which fits against the wall.
Figure 3:
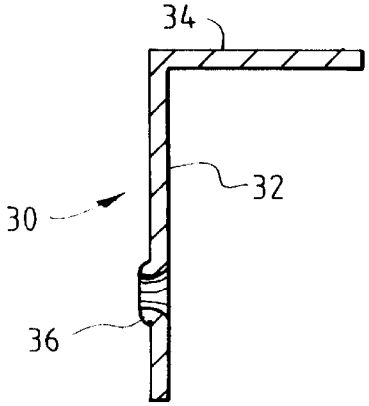
FIG. 3 is a cross sectional view taken along line 3—3 of FIG. 2.
Figure 4:
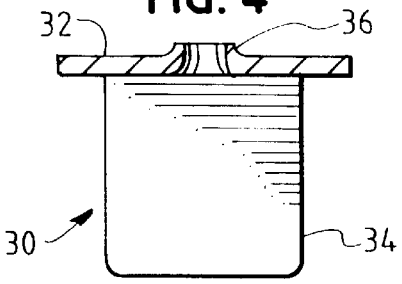
FIG. 4 is a cross section taken along line 4—4 of FIG. 2.
Figure 5:
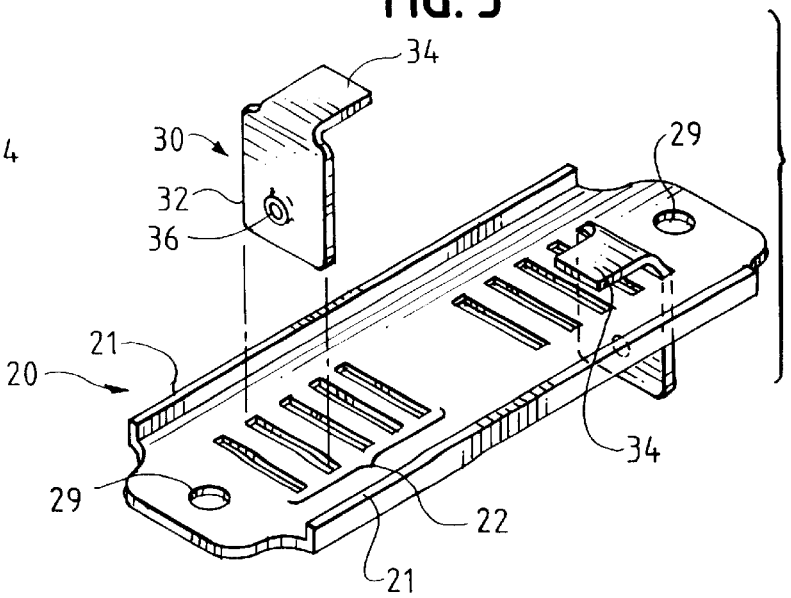
FIG. 5 is a perspective view of the elongated member of FIG. 1 with one of the L-shaped members in place and with a second L-shaped member poised over the elongated plate and about to be inserted into a slot.

Two L-shaped members 30 (FIGS. 2–4) are supplied and associated with the elongated plate 20. Each L-shaped member has a first flange 32 which is shaped and dimensioned to fit through any one of the slots 22, 24 and to depend from plate 20. The other flange 34 of the L-shaped member 30 is shaped and dimensioned to fit between the upturned edges 21—21 on plate 20.

Figure 6:
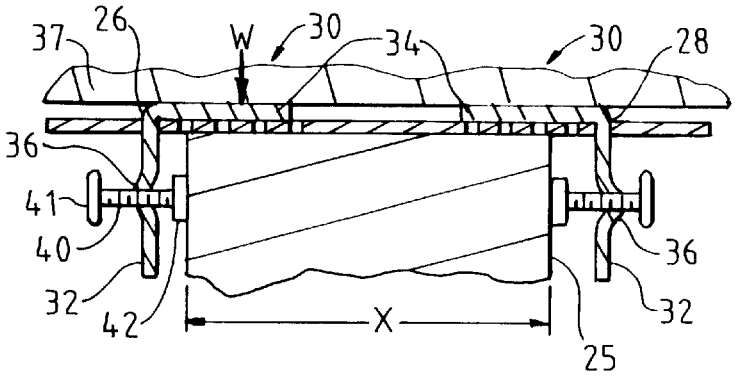
FIG. 6 shows the assembled support (taken along line 6—6 of FIG. 1) with a flower box, or the like, holding the assembly in place.

The outer end of the first flange 32 contains a flared detent 36 which projects slightly above the surface of the flange 34 in order to provide a threaded hole. If the threaded detent 36 projects too far and does not pass through the slot, the other flange 34 may be inserted through the slot and then the L-shaped member is rotated into the position with flange 32 depending below and flange 34 laying on the plate 20. In the embodiment of FIG. 6, when a flower box 37 is set upon the assembly, the weight W (FIG. 6) of the box tends to cause the L-shaped member 30 to be locked in place.

A clamp 40–42 having threaded bolt 40 is mounted in the threaded hole formed by the flared detent 36. On the outer end of the threaded bolt 40, a handle 41 enables the installer to turn the bolt. On the inner end of the bolt, a relatively flat clamping member 42 is positioned to grip the wall responsive to a turning of the bolt 40. Preferably, the handle 40 is removable. Or, either the handle 41 or the flat member 40 is installed on bolt 40 after it is threaded through hole 36. Alternatively, a screwdriver, or the like can turn the bolt 40.

Figure 7:
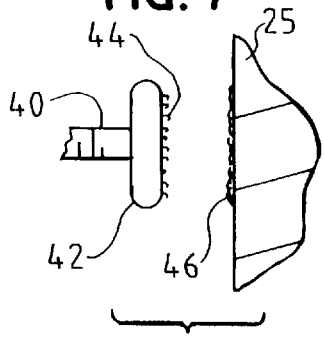
FIG. 7 is a schematic view of an end of a clamp used to secure the assembly to a room divider.

As best seen in FIG. 7, the clamping member 42 is covered with the hooks 44 of a hook and loop fastener sold under the trademark "Velcro." The loops 46 of the "Velcro" fastener are adhered to the wall. Usually, these "Velcro" members are secured by a self-adhesive covered by a release paper (not shown) until the members are installed. The easy way to make this installation is to peel off the release paper on the hook side and stick the combination on the clamping member 42. Then, the release paper is peeled off the loop side and the clamp is tightened against the wall, thereby securing the loop side 46 in a nearly perfect position. The two dependent flanges 32, 32 now tightly embrace and clutch the wall 25.

Figure 8:
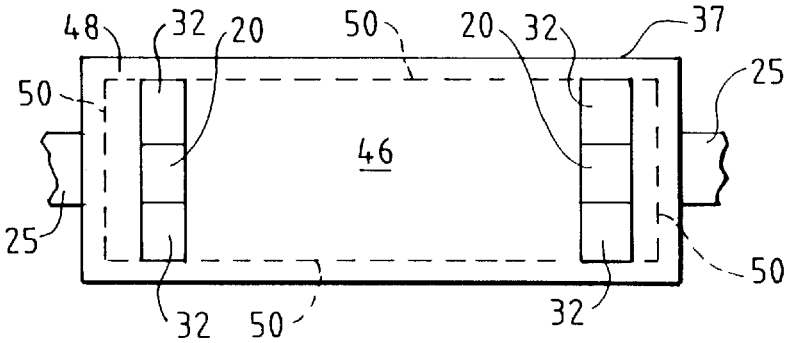
FIG. 8 is a plan view of a room divider, a flower box, and the inventive support assembly.

In greater detail, FIG. 8 is a schematic showing of the inventive support in use. Two of the elongated plates 20 are preferably attached to the bottom of flower box 37 and the box is positioned over the top edge of a wall 25, room divider, or other support 25. These two plates are separated by a distance which puts them adjacent the ends of the flower box 37. Of course, the invention is not limited to a use of only two elongated plates 20. Any suitable number of supporting elongated plates 20 and their associated pair of L-shaped members 30 may be provided.

The flanges 32 may be either decorative to add to the appearance of the flower box; or, they may be neutrally colored to minimize their noticeability, when in place.

Figure 9:
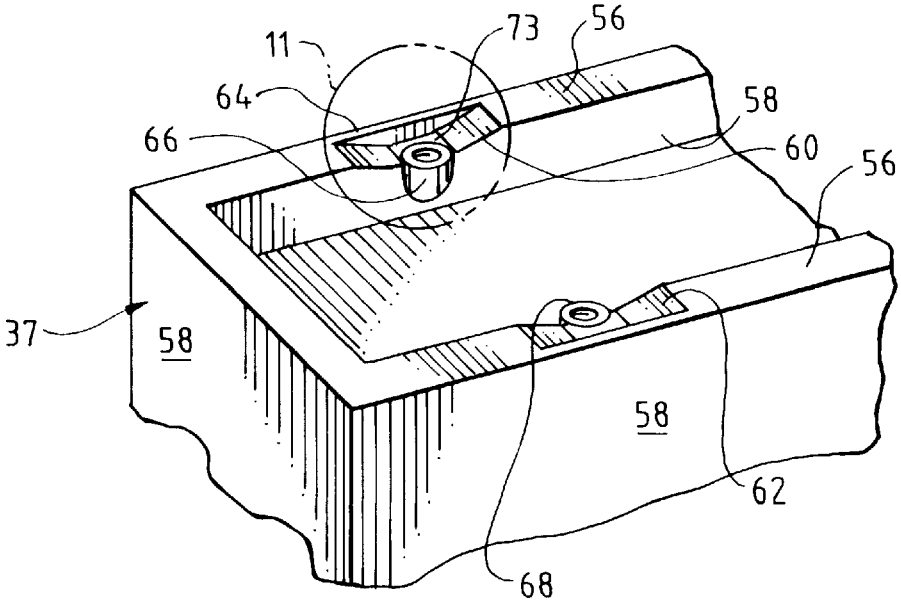
FIG. 9 is a perspective view showing the bottom of a flower box before the invention is installed.
Figure 10:
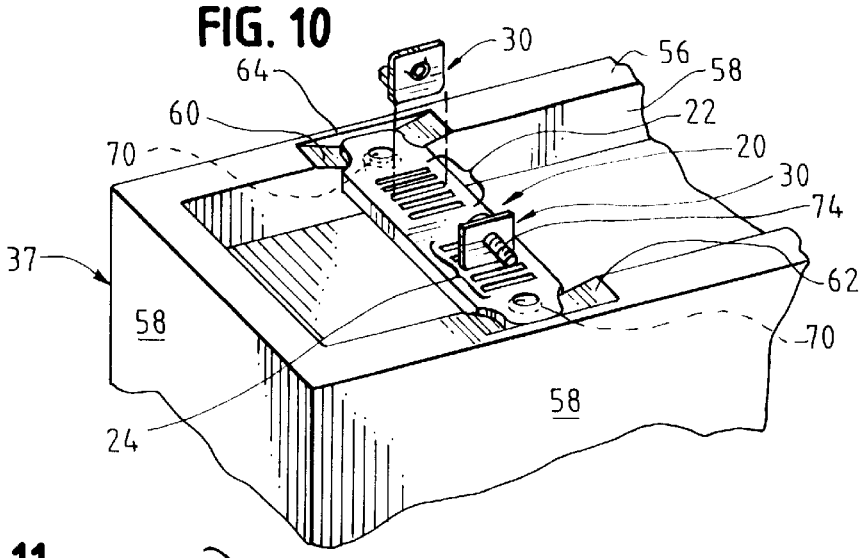
FIG. 10 is essentially the same as FIG. 9, except that the inventive mount is installed.
Figure 11:
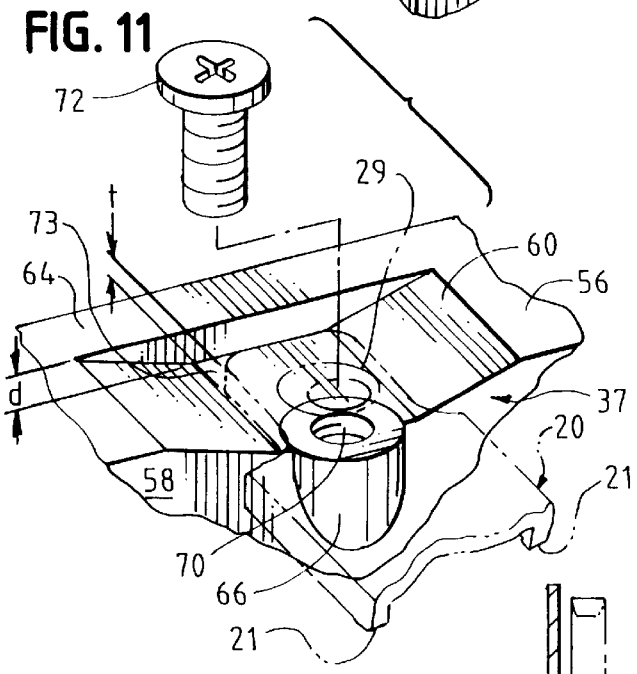
FIG. 11 is a showing of the detail 11 in FIG. 9 and with the elongated plate shown in phantom lines.

In the embodiment of FIGS. 9–11, the flower box 37 has depressions 60, 62 formed in the lower surface of the side wall in order to receive the ends of the elongated plate 20. These depressions enable the ends of the elongated plates 20 to be approximately flush with the surface of the bottom wall.

In greater detail, the flower box 37 is preferably made of molded plastic of any suitable shape and design, although any suitable material may be used. The bottom surface 56 of the box side walls 58 has a depression 60, 62 formed in each location where the end of an elongated plate 20 is to be attached to the box. Upstanding on one side of each depression is a thin wall 64 which has a depth d (FIG. 11) approximately equal to the thickness t of the end of plate 20 so that, after it is attached, the top surface of the plate is substantially flush with the exposed edge of thin wall 64 on the bottom surface 56 of the flower box side wall 58.

An upstanding boss 66, 68 is molded in each depression 60, 62 at a location where it will receive mounting hole 29 (FIGS. 1 and 11) near the end of the elongated plate 20. Each boss has a hole 70 therein for receiving a bolt 72 which secures plate 20 to the flower box 37.

The height of the boss above the floor 73 of the depression is approximately equal to the depth d of thin wall 64 and thickness t of the end of elongated plate 20. Therefore, when holes 29 in the elongated plate 20 are in position over the bosses, the tops of the bosses will be approximately flush with or slightly countersunk below the surface of plate 20. The fit between plate and boss insures that the elongated plate 20 is securely held in place when bolt 72 is tightened into the hole 70 of the boss 66 or 68.

Figure 12:
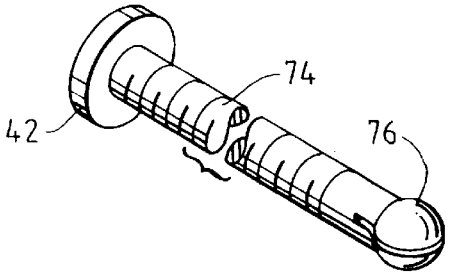
FIG. 12 shows a detail of the clamping screw for the embodiment of FIGS. 9–11.
Figure 13:
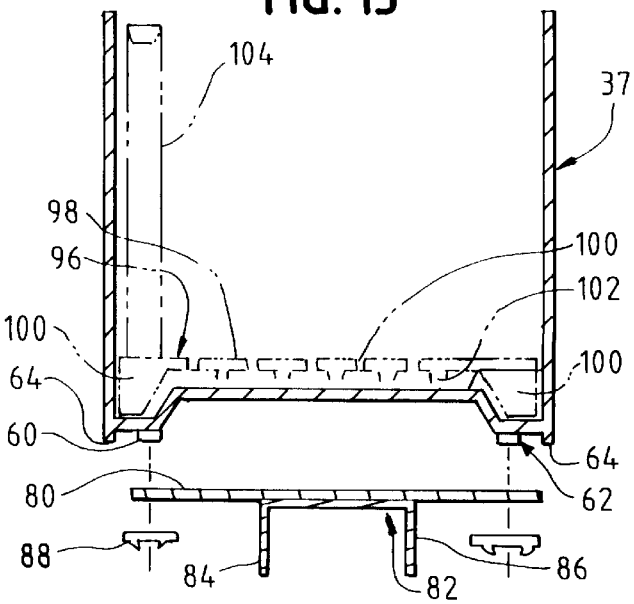
FIG. 13 is an exploded view, partly in cross-section, of a flower box with an embodiment of the inventive support which fits onto walls or room dividers of standard thickness.
Figure 14:
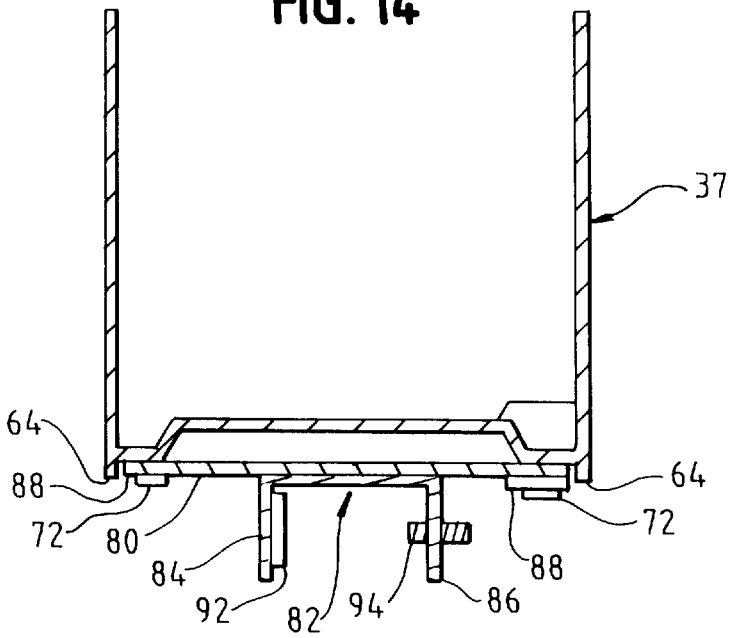
FIG. 14 is a view of FIG. 13 assembled.

At least one of the L-shaped plates 32 has a bolt 74 (FIG. 12) therein for tightening the support to the wall, room divider 25 (FIG. 6) or the like. This bolt may be constructed as bolt 40 (FIG. 6) is constructed with a face plate carrying a "Velcro" hook and loop fastener. It may simply have a slot 76 (FIG. 12) for receiving the blade of a screwdriver. Those skilled in the art will readily perceive other ways in which the end of bolt 74 may be shaped to accommodate other means for turning it.

Figure 15:
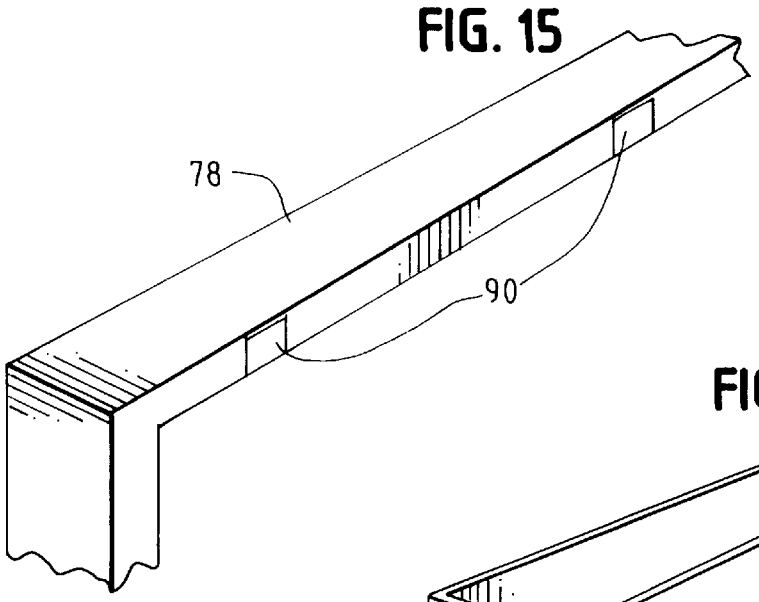
FIG. 15 is a perspective view of a type of room divider which may be supplied by a furniture manufacturer, for example.

Sometimes the thickness of the wall or room divider 78 (FIGS. 15, 16) is completely predictable. For this kind of an installation, there is no need for the adjustments which are described above and the embodiment of FIGS. 13–16 may be used.

The mounting structure comprises an elongated plate 80 having a U-shaped member 82 with the bottom of the U spot welded or otherwise jointed thereto. The U-shaped member 82 has two dependent flanges 84, 86 formed by the arms of the U which are spaced from each other by the thickness of the supporting wall or room divider 78. The elongated plate 80 fits over and is attached to bosses 60, 62, which are essentially the same as in FIGS. 9–11. Lock washers 88 may be supplied here, or in any of the other embodiments to help secure the bolt.

In this embodiment, preferably the loop side pieces 90 of "Velcro" hook and loop fasteners are fastened to the wall or room divider 78 at positions where the U-shaped members 82 are located. The hook side 92 of the "Velcro" fastener is located inside the flange 84 of the U-shaped member 82 which confronts the fastener pieces 90 on the wall or room divider. The opposite flange 86 has a bolt 94 for tightening against the wall.

Figure 16:
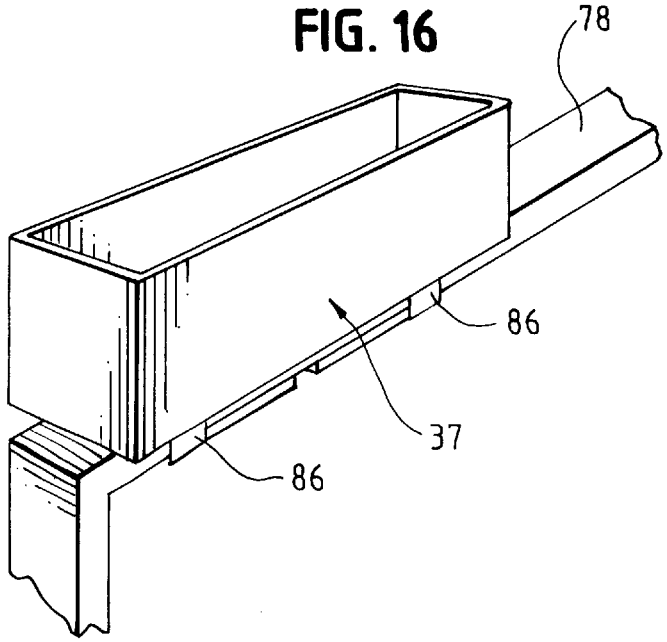
FIG. 16 shows a flower box of FIGS. 13–15, but it could be of any of the embodiments, mounted on a wall or divider.

FIG. 16 shows the flower box 37 mounted on the wall or room divider 78.

In any of the embodiments, an irrigation unit 96 (shown in phantom in FIG. 13) may be provided. This enables the watertight flower box to provide only the amount of water which a plant needs over a two to three week period. An advantage of this arrangement is that there is no overwatering. There is a convenience and a saving of labor, as compared to the prior art. The flower box is specifically designed to receive various sub-irrigation systems, which is a substantial advantage over previous flower boxes.

Those who are skilled in the art will readily perceive how to modify the invention. Therefore, the appended claims are to be construed to cover all equivalent structures which fall within the true scope and spirit of the invention.

The claimed invention is:

1. A supporting structure for mounting a box on the top edge of a wall member, said supporting structure comprising: (a) an elongated plate having a plurality of spaced parallel slots; (b) means for securing said elongated plate to said box; (c) a pair of L-shaped members each having two flanges, each of the L-shaped members being shaped and dimensioned to fit through said slots with a first of said flanges resting against said elongated plate and the other of said flanges depending from said elongated plate; and (d) a clamping member in at least one of said other flanges for engaging said wall member.

2. The structure of claim 1 wherein said clamping member comprises a flared detent with a threaded hole formed in each of said other flanges for receiving a threaded member which may be turned to form a clamp adapted to secure said supporting structure to said wall.

3. The structure of claim 2 and a hook and loop fastener adapted to be placed between an end of said threaded member and said wall.

4. The structure of claim 1 wherein said first flanges are adapted to be securely held against said elongated plate by the weight of said box to secure and stabilize the position of said L-shaped members.

5. The structure of claim 1 further comprising a second elongated plate and a second pair of said L-shaped members, the first elongated plate being adapted to be mounted at one end of said box, the second elongated plate being adapted to be mounted at the other end of said box and the first pair of said L-shaped members secured to said first elongated plate and the second pair of L-shaped members secured to said second elongated plate.

6. The structure of claim 1 wherein opposing longitudinal edges of said elongated plate are turned up to receive between them said first flanges of said L-shaped members, said turned up edges being spaced from each other so that said first flanges of said L-shaped members fit easily between said turned up edges.

7. A generally rectangular box having side walls and a bottom surface and a structure for supporting said box on the top of a wall member, said supporting structure comprising at least one elongated plate having a plurality of parallel slots spaced along the longitudinal dimension of said plate, a pair of L-shaped members associated with said elongated plate, said pair of L-shaped members being shaped to fit through and depend below said slots, said L-shaped members opposing each other and being adapted to embrace the top of said wall, a first flange of each L-shaped member laying between upturned edges on said elongated plate and means associated with said L-shaped members adapted to clamp said supporting structure to the top of said wall.

8. The structure of claim 7 wherein each elongated plate has an associated pair of L-shaped members, said elongated plates being distributed along a length of said box.

9. The structure of claim 8 wherein a hole is formed in each end of each said elongated plates to enable an attachment of said elongated plates to said box.

10. The structure of claim 9 wherein said clamping means comprises a flared detent with a threaded hole formed in a second flange of one of said L-shaped members for receiving a threaded member which may be turned for securing said supporting structure to said wall.

11. The structure of claim 10 and a hook and loop fastener adapted to be placed between said threaded member and said wall.

12. The structure of claim 9 wherein the bottom surface of said box is depressed at each location which is engaged by said elongated plates so that an exposed surface of said elongated plate is flush with said box at said locations.

13. The structure of claim 12 and a boss formed in said depression for receiving said hole formed in each end of said elongated plate, said boss including means for securing said elongated plate to said box.

* * * * *